US008307769B1

(12) United States Patent
Wescott

(10) Patent No.: US 8,307,769 B1
(45) Date of Patent: Nov. 13, 2012

(54) PLASTIC AND PLYWOOD LAMINATE TABLE WITH DROP CORNER

(75) Inventor: Lane Wescott, Spanish Fork, UT (US)

(73) Assignee: Mity-Lite, Inc., Orem, UT (US)

( * ) Notice: Subject to any disclaimer, the term of this patent is extended or adjusted under 35 U.S.C. 154(b) by 179 days.

(21) Appl. No.: 12/819,470

(22) Filed: Jun. 21, 2010

Related U.S. Application Data

(60) Provisional application No. 61/230,449, filed on Jul. 31, 2009.

(51) Int. Cl.
*A47B 17/00* (2006.01)

(52) U.S. Cl. ..... 108/27; 108/132

(58) Field of Classification Search ..... 108/27, 108/161, 132, 129, 180, 192, 193, 153.1, 108/157.14; 248/188, 188.1, 345.1; 211/153, 211/198, 189
See application file for complete search history.

(56) References Cited

U.S. PATENT DOCUMENTS

| | | | | |
|---|---|---|---|---|
| 50,891 | A | 11/1856 | Batchelor | |
| 811,209 | A | 1/1906 | Farrell | |
| 827,834 | A | 8/1906 | Westby | |
| 953,413 | A | 3/1910 | Eggers | |
| 1,007,727 | A | 11/1911 | Onken | |
| 1,335,704 | A | 3/1920 | Russell et al. | |
| 1,439,002 | A | 12/1922 | Jourdan | |
| 1,526,009 | A | 2/1925 | Partington | |
| 1,542,138 | A | 6/1925 | Hunter | |
| 1,684,966 | A | 9/1928 | O'Conor | |
| 1,801,080 | A | 4/1931 | Hart et al. | |
| 1,860,644 | A | 5/1932 | Bales et al. | |
| 2,162,777 | A | 6/1939 | Hagopian | |
| 2,278,331 | A | 3/1942 | Mayercord | |
| 2,298,578 | A * | 10/1942 | Madsen | 108/27 |
| 2,304,718 | A | 12/1942 | Swart | |
| 2,535,920 | A | 12/1950 | Hart et al. | |
| 2,539,461 | A | 1/1951 | Norquist | |
| 2,542,860 | A | 2/1951 | Clements | |
| 2,650,185 | A | 8/1953 | Larson et al. | |
| 2,681,261 | A | 10/1953 | Blink | |
| 2,657,964 | A | 11/1953 | Watrous | |
| 2,717,187 | A * | 9/1955 | Morgan et al. | 108/27 |
| 2,786,727 | A | 3/1957 | Nordmark | |
| 2,851,322 | A | 9/1958 | Molla | |

(Continued)

FOREIGN PATENT DOCUMENTS

DE 3641967 10/1987

OTHER PUBLICATIONS

Web Page: www.Amazon.com: Eastman Outdoors Aluminum Folding Table/dp/B00006JEGG ; printed Jan. 26, 2009; 7 pgs.

(Continued)

*Primary Examiner* — Jose V Chen
(74) *Attorney, Agent, or Firm* — Thorpe North & Western LLP

(57) ABSTRACT

A light-weight, folding table has a plurality of folding legs coupled to a table top. The table top includes a laminate with a plastic sheet bonded to a plywood layer. A perimeter edge channel encloses a perimeter edge of the laminate along the sides without enclosing corners of the laminate. Corner caps cover the corners of the laminate. The corner caps overlap ends of the edge channel at the corner.

20 Claims, 13 Drawing Sheets

U.S. PATENT DOCUMENTS

| | | | | | |
|---|---|---|---|---|---|
| 2,876,053 | A | * | 3/1959 | Eves | 108/27 |
| 2,889,184 | A | | 6/1959 | Golff | |
| 2,889,185 | A | | 6/1959 | Heisler | |
| 2,890,919 | A | * | 6/1959 | Hansen | 108/27 |
| 2,905,334 | A | | 9/1959 | Gottschalk et al. | |
| 2,926,361 | A | * | 3/1960 | Hornik | 108/27 |
| 2,940,805 | A | | 6/1960 | Nordmark | |
| 2,978,895 | A | | 4/1961 | Heisler | |
| 2,996,764 | A | | 8/1961 | Ross et al. | |
| 3,021,575 | A | | 2/1962 | Heisler | |
| 3,061,369 | A | | 10/1962 | Haunost | |
| 3,065,860 | A | | 11/1962 | Swanson | |
| 3,074,770 | A | | 1/1963 | Joos | |
| 3,150,032 | A | | 9/1964 | Rubenstein | |
| 3,159,114 | A | | 12/1964 | Haunost | |
| 3,164,110 | A | | 1/1965 | Bofinger | |
| 3,174,893 | A | | 3/1965 | Church et al. | |
| 3,190,649 | A | | 6/1965 | Heisler | |
| 3,213,570 | A | | 10/1965 | Abramson, Jr. | |
| 3,219,401 | A | | 11/1965 | Mapson | |
| 3,223,056 | A | | 12/1965 | Wilburn | |
| 3,328,500 | A | | 6/1967 | Barnette | |
| 3,337,662 | A | | 8/1967 | Spencer | |
| 3,475,030 | A | | 10/1969 | Prescott | |
| 3,610,175 | A | | 10/1971 | Wilton et al. | |
| 3,622,216 | A | | 11/1971 | Haunost | |
| 3,628,470 | A | | 12/1971 | DeLuca | |
| 3,698,329 | A | | 10/1972 | Diamond et al. | |
| 3,700,533 | A | | 10/1972 | Schmitz | |
| 3,724,078 | A | | 4/1973 | Carlin et al. | |
| 3,761,554 | A | | 9/1973 | Barnette | |
| 3,832,264 | A | | 8/1974 | Barnette | |
| 3,836,043 | A | | 9/1974 | Levin | |
| 3,837,298 | A | | 9/1974 | Leonhart | |
| 3,856,451 | A | | 12/1974 | Holzinger | |
| 3,880,092 | A | | 4/1975 | Seeber et al. | |
| 3,915,098 | A | | 10/1975 | Nania | |
| 3,920,295 | A | | 11/1975 | Speckin | |
| 3,960,354 | A | | 6/1976 | Simikoski | |
| 3,962,390 | A | | 6/1976 | Mori et al. | |
| 3,971,181 | A | | 7/1976 | Zetlin | |
| 3,999,397 | A | | 12/1976 | Albery | |
| 4,099,887 | A | | 7/1978 | Mackenroth | |
| 4,101,233 | A | | 7/1978 | McConnell | |
| 4,111,482 | A | | 9/1978 | Jones | |
| 4,112,855 | A | | 9/1978 | Colby | |
| 4,138,953 | A | | 2/1979 | Tashman | |
| 4,278,196 | A | | 7/1981 | Ford | |
| 4,337,107 | A | | 6/1982 | Eshleman | |
| 4,341,164 | A | | 7/1982 | Johnson | |
| 4,397,247 | A | | 8/1983 | Lemelson | |
| 4,503,780 | A | | 3/1985 | Apissomian | |
| D280,371 | S | | 9/1985 | Bayly | |
| 2,860,383 | A | | 11/1985 | Heisler | |
| 4,560,523 | A | | 12/1985 | Plumley et al. | |
| 4,569,496 | A | | 2/1986 | Fleishman | |
| 4,606,170 | A | | 8/1986 | Mendenhall | |
| 4,671,753 | A | | 6/1987 | Payne | |
| 4,676,041 | A | | 6/1987 | Ford | |
| 4,689,257 | A | | 8/1987 | Baum | |
| 4,696,406 | A | | 9/1987 | Karashima | |
| 4,706,436 | A | | 11/1987 | Mabey et al. | |
| 4,708,183 | A | | 11/1987 | Figueroa | |
| 4,715,503 | A | | 12/1987 | Johnson | |
| 4,727,816 | A | | 3/1988 | Virtue | |
| 4,749,533 | A | | 6/1988 | Payne | |
| 4,805,541 | A | | 2/1989 | Drane et al. | |
| 4,809,755 | A | | 3/1989 | Pontikas | |
| 4,841,877 | A | | 6/1989 | Virtue | |
| 4,883,001 | A | | 11/1989 | Roth | |
| 4,904,022 | A | | 2/1990 | Morozzi | |
| 4,998,697 | A | | 3/1991 | Esposito | |
| 5,011,636 | A | | 4/1991 | Payne | |
| 5,044,690 | A | | 9/1991 | Torrey | |
| 5,081,725 | A | | 1/1992 | Neese | |
| 5,102,077 | A | | 4/1992 | Glendinning | |
| 5,114,265 | A | | 5/1992 | Grisley | |
| 5,142,996 | A | | 9/1992 | Thorn | |
| 5,152,481 | A | | 10/1992 | Cote et al. | |
| 5,152,591 | A | | 10/1992 | Beals | |
| 5,173,348 | A | | 12/1992 | Gevaert et al. | |
| 5,213,861 | A | | 5/1993 | Severson et al. | |
| 5,241,914 | A | | 9/1993 | Korb | |
| D341,271 | S | | 11/1993 | Pesso | |
| 5,271,338 | A | | 12/1993 | Bonham | |
| 5,273,258 | A | * | 12/1993 | Bedics | 248/345.1 |
| 5,284,100 | A | | 2/1994 | Thorn | |
| 5,311,825 | A | | 5/1994 | Bonham | |
| 5,320,048 | A | | 6/1994 | Feiner | |
| 5,362,063 | A | | 11/1994 | Cummings | |
| 5,366,675 | A | | 11/1994 | Needham | |
| 5,374,180 | A | | 12/1994 | Bauer | |
| 5,389,316 | A | | 2/1995 | Kerman | |
| 5,394,808 | A | | 3/1995 | Dutro et al. | |
| 5,424,108 | A | * | 6/1995 | Whetstone | 248/345.1 |
| 5,436,048 | A | | 7/1995 | Meier et al. | |
| 5,440,857 | A | | 8/1995 | Shanok et al. | |
| 5,443,020 | A | | 8/1995 | Price | |
| 5,464,305 | A | | 11/1995 | Liem | |
| 5,473,997 | A | | 12/1995 | Solomon et al. | |
| 5,527,579 | A | | 6/1996 | Aho | |
| 5,532,282 | A | | 7/1996 | Needham | |
| 5,549,055 | A | | 8/1996 | Kusch | |
| 5,638,761 | A | | 6/1997 | Berkowitz et al. | |
| 5,678,491 | A | | 10/1997 | Price et al. | |
| 5,694,865 | A | | 12/1997 | Raab | |
| 5,732,637 | A | | 3/1998 | Raab | |
| 5,759,472 | A | | 6/1998 | DeFranco et al. | |
| 5,783,611 | A | | 7/1998 | Strebel | |
| 5,809,901 | A | * | 9/1998 | Gutzmer | 108/27 |
| 5,868,081 | A | | 2/1999 | Raab | |
| 5,871,219 | A | | 2/1999 | Elliott | |
| 5,888,114 | A | | 3/1999 | Slocum et al. | |
| D412,254 | S | | 7/1999 | Gower | |
| 5,928,584 | A | | 7/1999 | Lee et al. | |
| 5,947,037 | A | * | 9/1999 | Hornberger et al. | 108/27 |
| 5,964,165 | A | | 10/1999 | Schmidt et al. | |
| 5,983,807 | A | | 11/1999 | Tarnay et al. | |
| 6,018,927 | A | | 2/2000 | Major | |
| 6,024,903 | A | | 2/2000 | Naft et al. | |
| 6,058,854 | A | | 5/2000 | Tarnay et al. | |
| 6,083,434 | A | | 7/2000 | Strebel | |
| 6,127,019 | A | | 10/2000 | Means | |
| 6,180,203 | B1 | | 1/2001 | Unkles | |
| 6,199,489 | B1 | | 3/2001 | Tsai | |
| 6,245,266 | B1 | | 6/2001 | Ramesh | |
| 6,261,490 | B1 | | 7/2001 | Kliene | |
| D448,938 | S | | 10/2001 | Ng et al. | |
| 6,308,469 | B1 | | 10/2001 | Leung | |
| 6,334,504 | B1 | | 1/2002 | Sato et al. | |
| D456,155 | S | | 4/2002 | DeVriendt | |
| 6,389,989 | B1 | | 5/2002 | Hagerty | |
| 6,536,359 | B2 | | 3/2003 | Liu | |
| 6,615,743 | B2 | | 9/2003 | Nien | |
| 6,694,897 | B2 | | 2/2004 | Lou-Hao | |
| 6,712,009 | B2 | | 3/2004 | Buntre et al. | |
| 6,824,860 | B2 | | 11/2004 | Edwards et al. | |
| 6,837,171 | B1 | | 1/2005 | Clark et al. | |
| 6,848,370 | B1 | | 2/2005 | Stanford | |
| 6,892,860 | B2 | | 5/2005 | Gibson et al. | |
| 6,901,867 | B2 | | 6/2005 | Strong et al. | |
| 6,915,748 | B2 | | 7/2005 | Stanford | |
| 6,915,749 | B2 | | 7/2005 | Chang | |
| 6,959,651 | B2 | | 11/2005 | Li | |
| 6,968,789 | B2 | * | 11/2005 | Baik et al. | 108/132 |
| D519,746 | S | | 5/2006 | Ng et al. | |
| 7,059,255 | B2 | | 6/2006 | Tsai | |
| 7,143,702 | B2 | | 12/2006 | Stanford | |
| 7,150,237 | B2 | | 12/2006 | Lin et al. | |
| 7,157,034 | B2 | | 1/2007 | Bristow et al. | |
| 7,171,911 | B1 | | 2/2007 | Rivera, Jr. et al. | |
| D541,549 | S | | 5/2007 | Ng et al. | |
| 7,229,231 | B2 | | 6/2007 | Yu | |
| 7,251,920 | B2 | | 8/2007 | Timmerman et al. | |
| 7,270,062 | B1 | | 9/2007 | Larson | |
| 7,278,361 | B2 | | 10/2007 | Zhurong et al. | |
| 7,328,663 | B2 | * | 2/2008 | Leng | 108/27 |

| | | | | |
|---|---|---|---|---|
| 7,360,343 | B1 | 4/2008 | Spransy et al. | |
| 7,361,123 | B1 | 4/2008 | Krull | |
| 7,472,655 | B2 | 1/2009 | Leng | |
| 7,641,414 | B1 | 1/2010 | Joyce | |
| 7,703,398 | B2 | 4/2010 | Brauning et al. | |
| 2002/0096094 | A1 | 7/2002 | Lira | |
| 2002/0152934 | A1 | 10/2002 | Haney | |
| 2003/0005864 | A1 * | 1/2003 | Wen | 108/132 |
| 2003/0044231 | A1 | 3/2003 | Anvick | |
| 2004/0045488 | A1 | 3/2004 | Danzik et al. | |
| 2004/0159622 | A1 | 8/2004 | Craft et al. | |
| 2005/0129921 | A1 | 6/2005 | Laws et al. | |
| 2005/0184419 | A1 | 8/2005 | Laws et al. | |
| 2005/0274306 | A1 | 12/2005 | Strong | |
| 2006/0032417 | A1 | 2/2006 | Goschy et al. | |
| 2006/0081158 | A1 | 4/2006 | Ingham | |
| 2006/0117702 | A1 | 6/2006 | Lin | |
| 2006/0260519 | A1 | 11/2006 | Burns | |
| 2007/0039523 | A1 | 2/2007 | Helzer et al. | |
| 2007/0157857 | A1 | 7/2007 | Bottemiller | |
| 2007/0227412 | A1 | 10/2007 | Voris | |
| 2007/0227416 | A1 | 10/2007 | Wang | |
| 2007/0256614 | A1 | 11/2007 | Chen | |
| 2008/0211128 | A1 | 9/2008 | Lucier et al. | |
| 2008/0258514 | A1 | 10/2008 | Nichols et al. | |
| 2009/0189045 | A1 * | 7/2009 | Peckovich | 248/345.1 |
| 2009/0199746 | A1 | 8/2009 | Horton | |

OTHER PUBLICATIONS

Web Page: www.bistrotablesandbases.com/woodard/woven.htm; printed Jan. 26, 2009; 2 pgs.

Web Page: www.southernaluminum.com/catalog/pages/page1_p.html; printed Jan. 26, 2009; 13 pgs.

Web Page: www.southernaluminum.com/alulite_tables/benefits.html; printed Jan. 26, 2009; 4 pgs.

Web Page: www.jointech.com/tablesaw_fl.. Saw Train Floating Tables; printedOct. 6, 2008; 3 pgs.

Web Page: www.southernaluminum.com/alulite_tables/specifications. html; printed Jan. 26, 2009; 2 pgs.

Web Page: www.tropitone.com, printed Jan. 26, 2009; 2 pgs.

U.S. Appl. No. 12/106,796, filed Apr. 21, 2008; Jess Colton; office action issued Dec. 9, 2010.

U.S. Appl. No. 12/197,606, filed Aug. 25, 2008; David J. Laws; office action issued Dec. 23, 2010.

U.S. Appl. No. 12/767,975, filed Apr. 27, 2010; Tom Atkins; office action issued Jan. 31, 2012.

* cited by examiner

PLASTIC AND PLYWOOD LAMINATE TABLE WITH DROP CORNER

PRIORITY CLAIM

Priority is claimed to copending U.S. Provisional Patent Application Ser. No. 61/230,449, filed Jul. 31, 2009, which is hereby incorporated herein by reference in its entirety.

BACKGROUND

1. Field of the Invention

The present invention relates generally to light-weight, foldable tables.

2. Related Art

Folding tables are often used in applications where numerous tables are intermittently required. Therefore, such folding tables are provided with legs that fold towards the table top to provide a compact volume for storage. In addition, it is desirable that such tables have a reduced weight to facilitate handling and transportation. It is also desirable, however, that such tables remain robust, and provide a solid, flat working surface. To this extent, tables have been proposed that have a wood frame disposed between upper and lower shells of plastic; and which the upper plastic shell is laminated to an inner plywood sheet. For example, see U.S. Pat. No. 5,271,338 and U.S. Pat. No. 5,311,825. Some tables have been proposed with corner pieces. For example, see U.S. Pat. Nos. 3,219,401; 5,173,348 and 5,947,037.

SUMMARY OF THE INVENTION

It has been recognized that it would be advantageous to develop a folding table with a robust working surface and damage resistant and/or replaceable corners.

The invention provides a light-weight, folding table with a plurality of folding legs coupled to a table top and pivotal between an extended position maintaining the table top in an elevated position, and a collapsed position towards the table top. The table top includes a laminate with a plastic sheet bonded to a plywood layer. The plastic sheet defines an upper working surface of the table top. A perimeter edge channel encloses a perimeter edge of the laminate along the sides without enclosing corners of the laminate. Corner caps cover the corners of the laminate. The corner caps overlap ends of the edge channel at the corner.

The invention also provides a light-weight, folding table with a plurality of folding legs coupled to a table top and pivotal between an extended position maintaining the table top in an elevated position, and a collapsed position towards the table top. The table top includes a laminate with a plastic sheet bonded to a plywood layer. The plastic sheet defines an upper working surface of the table top. The plywood layer has a bottom surface with at least a majority exposed. At least one runner is coupled under the table top and directly to the bottom surface of the plywood layer. The runner includes a channel with an open side of the channel coupled to the table top.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

Figure 1A:
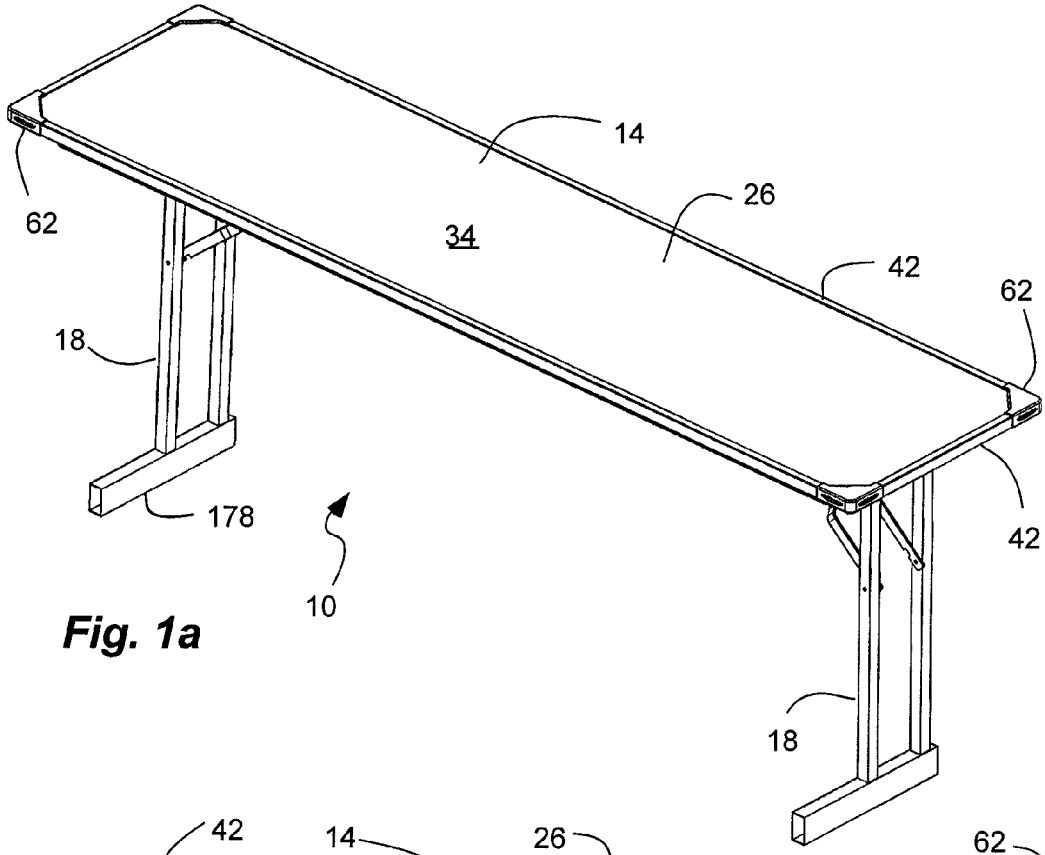
FIG. 1*a* is a top perspective view of a table in accordance with an embodiment of the present invention.
Figure 1B:
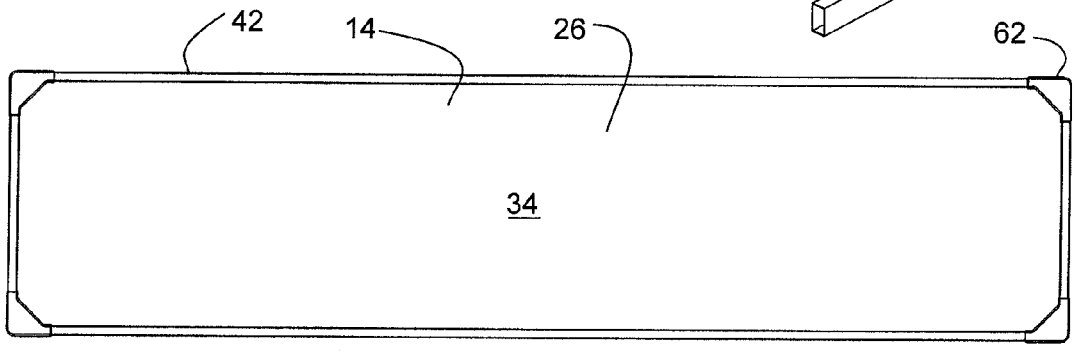
FIG. 1*b* is a top view of the table of FIG. 1*a;*
Figure 1C:
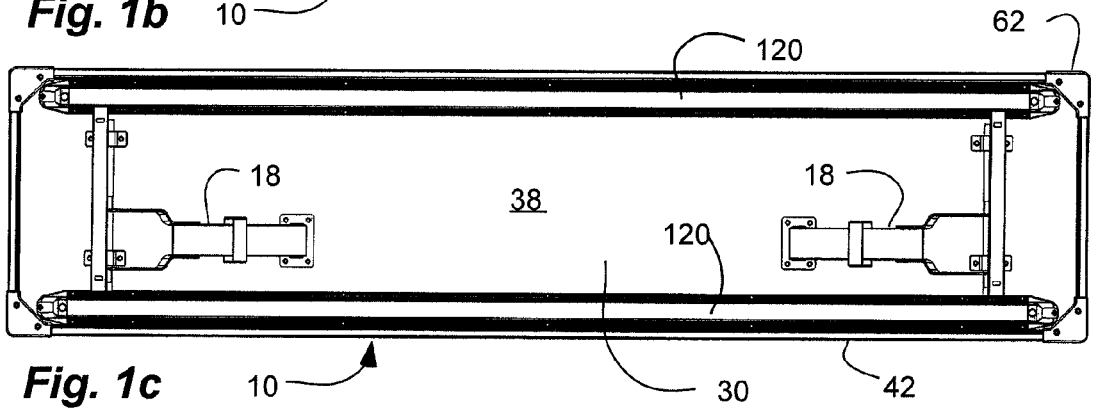
FIG. 1*c* is a bottom view of the table of FIG. 1*a;*
Figure 1D:
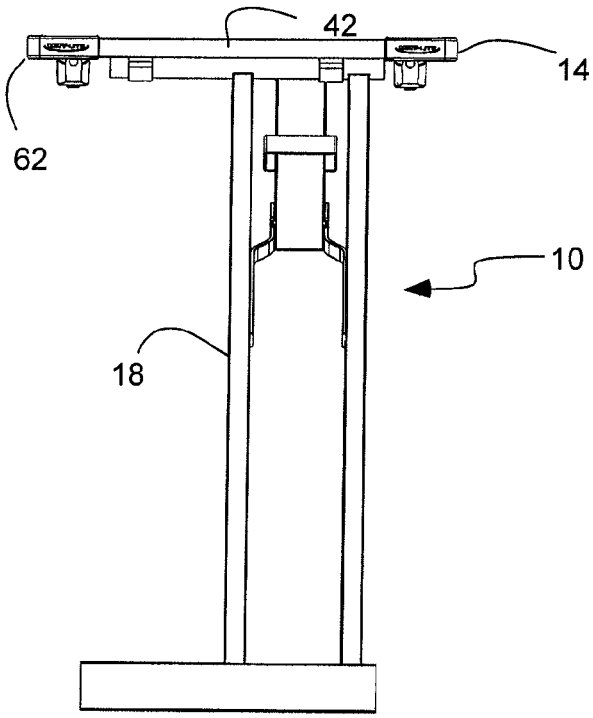
FIG. 1*d* is a side view of the table of FIG. 1*a;*
Figure 1E:
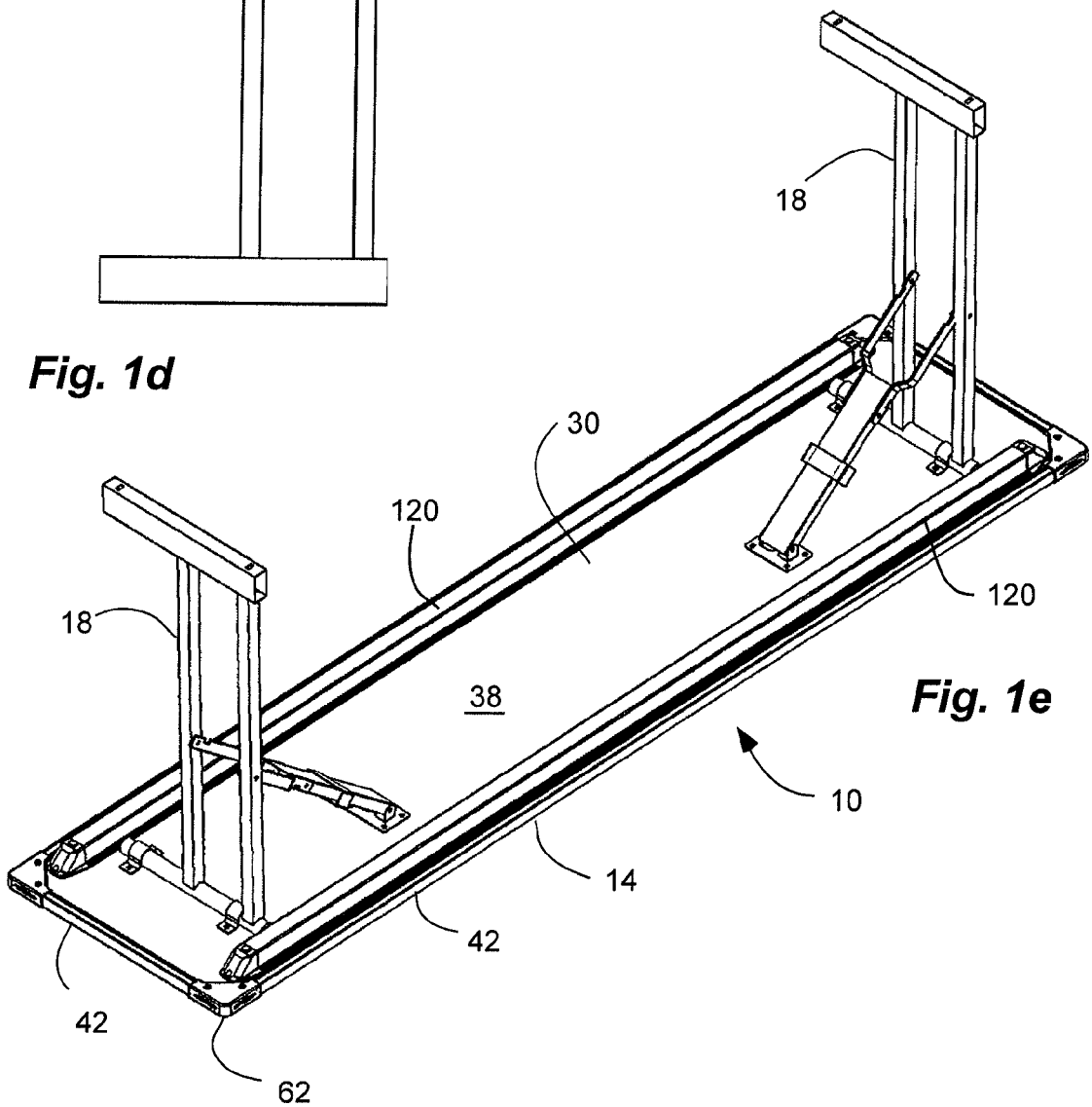
FIG. 1*e* is a bottom perspective view of the table of FIG. 1*a;*

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLE EMBODIMENT(S)

As illustrated in FIGS. 1*a*-3*b*, a light-weight, folding table device, indicated generally at 10, in an example implementation in accordance with the invention is shown. The table can be configured as a conference table, as discussed more fully below, that can be folded and stored and moved about as needed. Several such tables can be placed end to end to form a row; and several rows can be provided. The table can be long and narrow, or wide and shallow, to accommodate configurations with many rows. In addition, the table can provide a hard flat working surface, while remaining light-weight for portability. Furthermore, the table can have impact resistant corners or corners that absorb impact or corners that can be replaced to avoid damage that from such impacts that might occur during folding, unfolding, stacking and/or moving or arranging the table.

The table 10 includes a table top 14 with a plurality of folding legs or leg assemblies 18 coupled to the table top and pivotal between an extended position and a collapsed position. In the extended position, the legs maintain the table top in an elevated position (as shown). In the collapsed position the legs pivot towards the table top. Thus, the legs or leg assemblies can be pivotally coupled to the table top. As described above, several such tables can be configured as desired in the open position with the leg assemblies unfolded and the table top elevated. Such tables can be stacked for storage and/or transportation with the leg assemblies folded towards or against the table top. The tables can be stacked one on top of another with the tables in a horizontal orientation and the stack in a vertical configuration. Alternatively, the tables can be stacked laterally adjacent one another with the tables in a vertical orientation and the stack in a horizontal configuration.

The table top 14 includes a laminate 22 with an upper layer of plastic sheet 26, such as an ascrylonitrile butadiene styrene (ABS) plastic sheet, bonded to a lower layer or plywood layer 30 of plywood. The plastic sheet can have a thickness of approximately 0.050 inches and the plywood layer can have a thickness of approximately ⅝ inches. The plastic sheet 26 has an upper exposed surface defining an upper working surface 34 of the table top. The plywood layer 30 can have a bottom surface 38 with at least a majority exposed, or that is substantially exposed, without being covered by a bottom shell or plastic layer. Leaving a bottom of the laminate exposed can reduce the cost of the table and facilitate fabrication. The plastic sheet and plywood layer can share a common perimeter and have essentially the same planar surface area. The laminate, and the table, can be rectilinear, i.e. can have a square or rectangular shape with straight edges or sides meeting at corners. In addition, the laminate and table can have other polygon shapes with straight sides which meet at corners. The corners can have a slight curvature, or can be rounded, so that they are not sharp.

The opposite sides of the table or laminate can be longer than the opposite ends to form a rectangular shaped table top with the long sides designated as sides and the short sides designated as ends for convenience. It will be appreciated that all sides of the table can be of equal length to form a square shaped table (which is intended to be described by the term rectangular as well). The opposite sides can also designate front and back sides, as described in greater detail below. In the case of a conference table that is relatively long and shallow, tables can be configured end to end to form a longer row with users seated at the front side.

A perimeter edge channel 42, such as a J-channel or J-shaped channel, or C-channel or C-shaped channel, can be disposed along the edges or sides of the laminate. The channel can be straight to match straight edges of the laminate, or rolled to match curved edges of the laminate, as discussed in greater detail below. The edge channel 42 can enclose a perimeter edge of the laminate along the sides, but without enclosing corners of the laminate. Thus, several perimeter edge channels can have lengths shorter than the corresponding or respective side of the table or edge of the laminate so that the corners of the laminate are exposed with respect to the edge channel. The edge channel 42 can have distal ends that terminate short of the corners. Leaving the corners exposed with respect to the edge channel facilitates manufacture of the table by eliminating the precision required for cutting and attaching the edge channel. In addition, it is not necessary to form a corner in the edge channel.

Figure 2A:
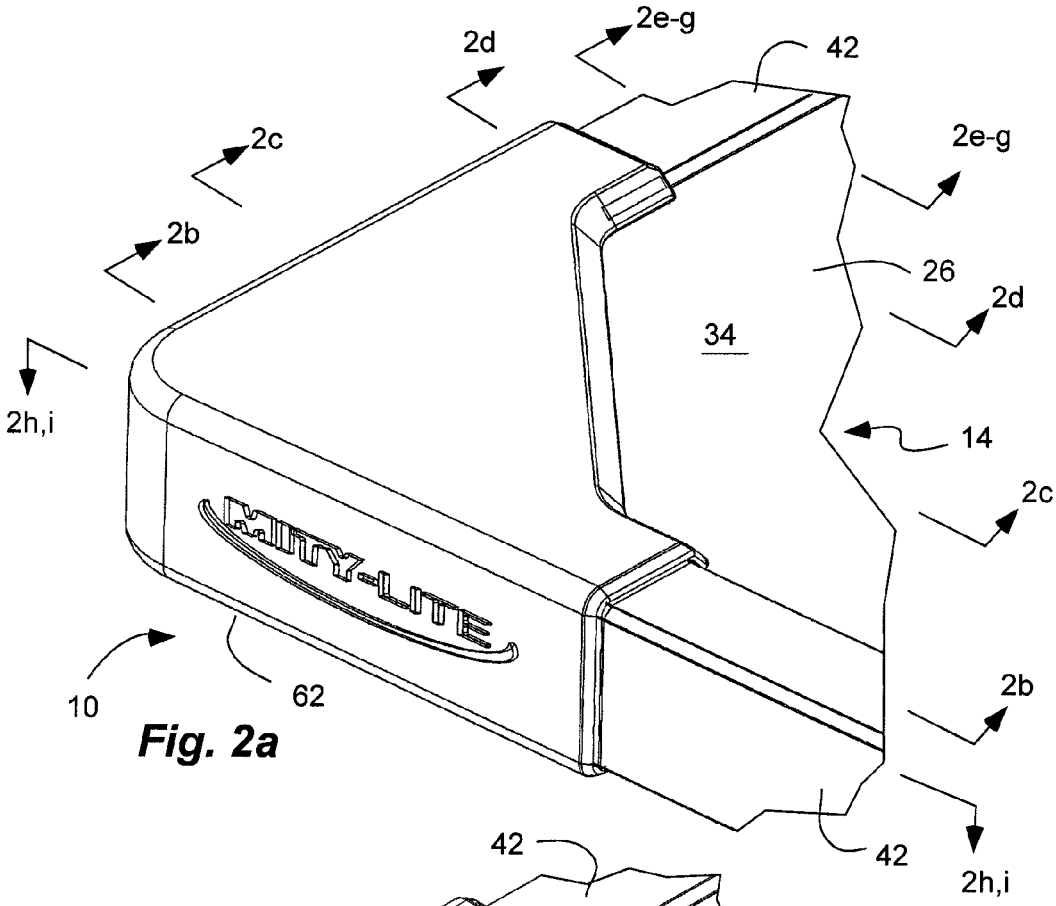
FIG. 2*a* is a partial top perspective view of the table of FIG. 1*a;*
Figure 2B:
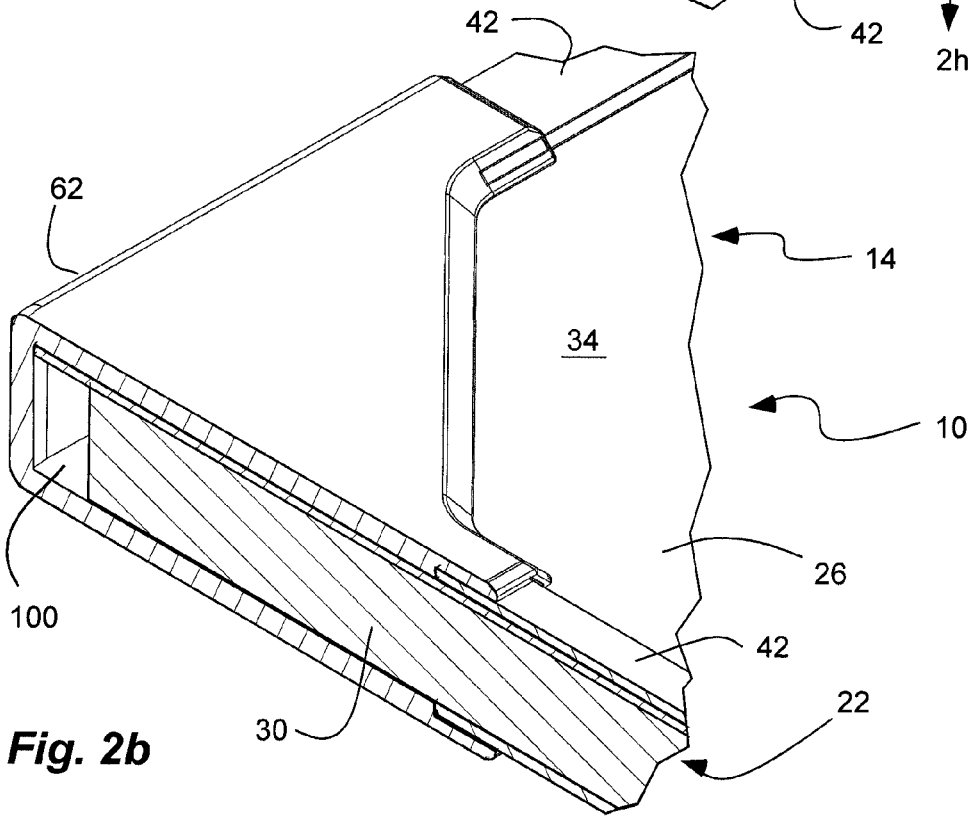
FIG. 2*b* is a partial cross-sectional perspective view of the table of FIG. 1*a;*
Figure 2C:
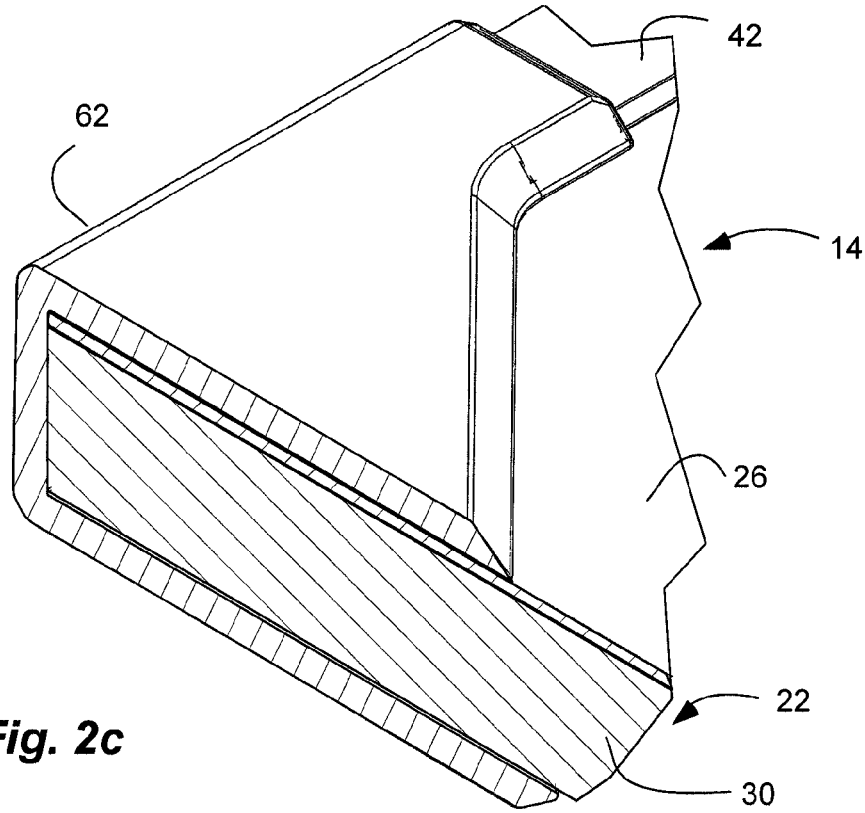
FIG. 2*c* is a partial cross-sectional perspective view of the table of FIG. 1*a;*
Figure 2D:
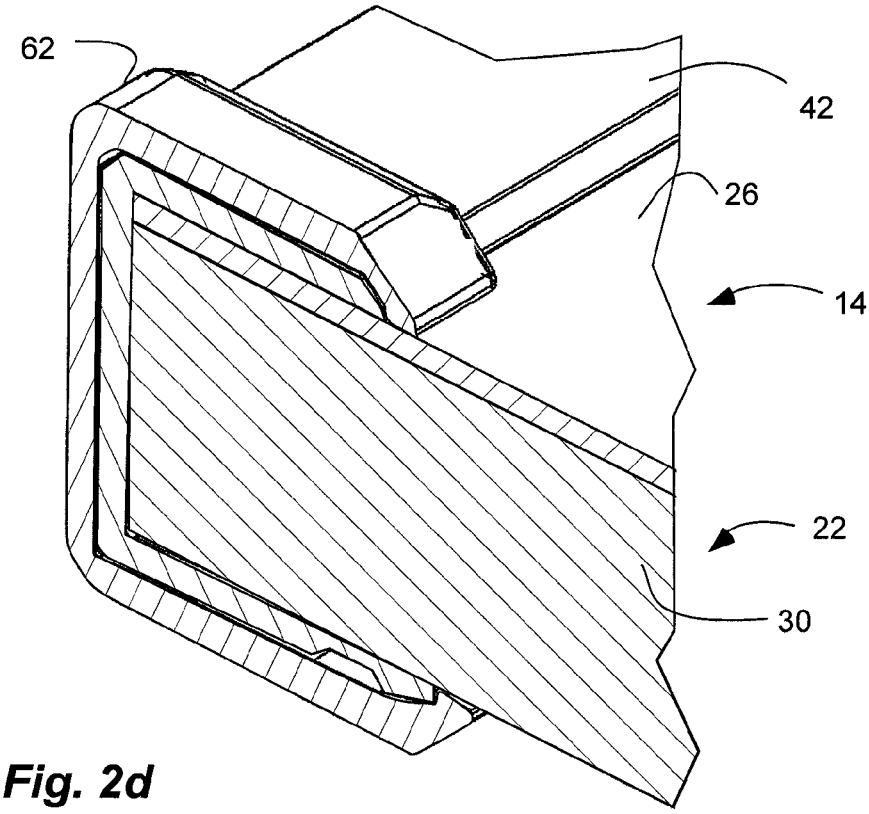
FIG. 2*d* is a partial cross-sectional perspective view of the table of FIG. 1*a;*
Figure 2E:
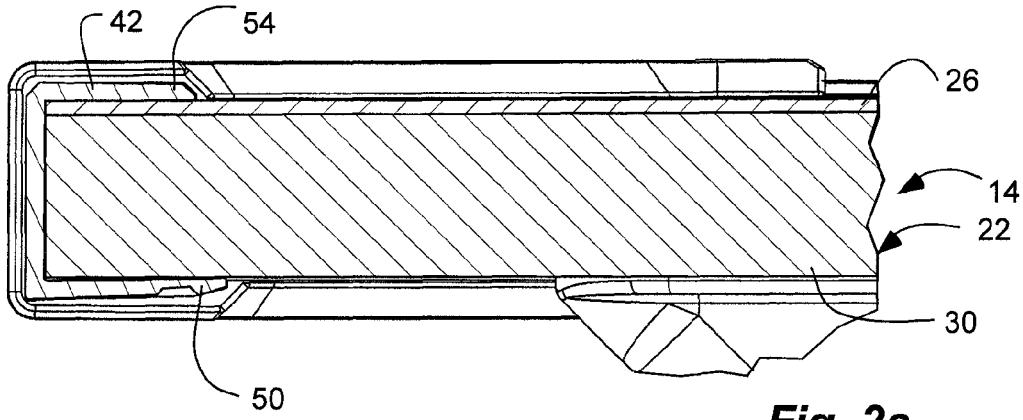
FIG. 2*e* is a partial cross-sectional side view of the table of FIG. 1*a;*
Figure 2F:
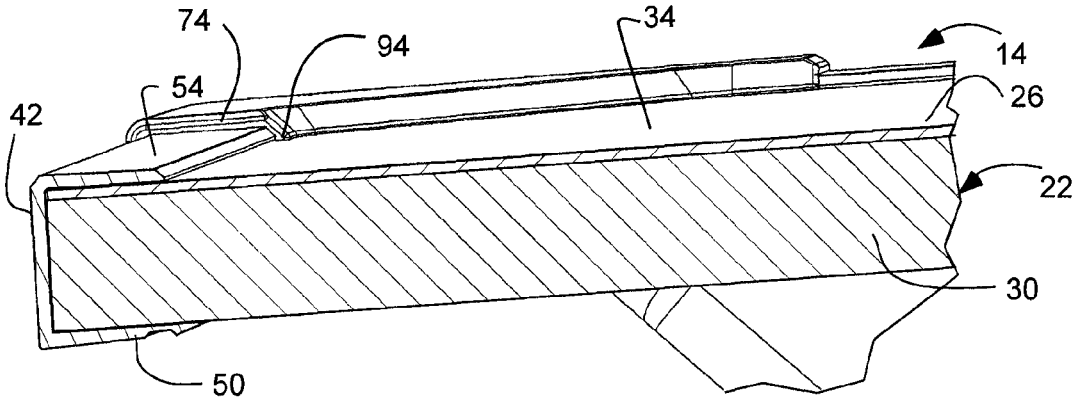
FIG. 2*f* is a partial cross-sectional perspective view of the table of FIG. 1*a;*
Figure 2G:
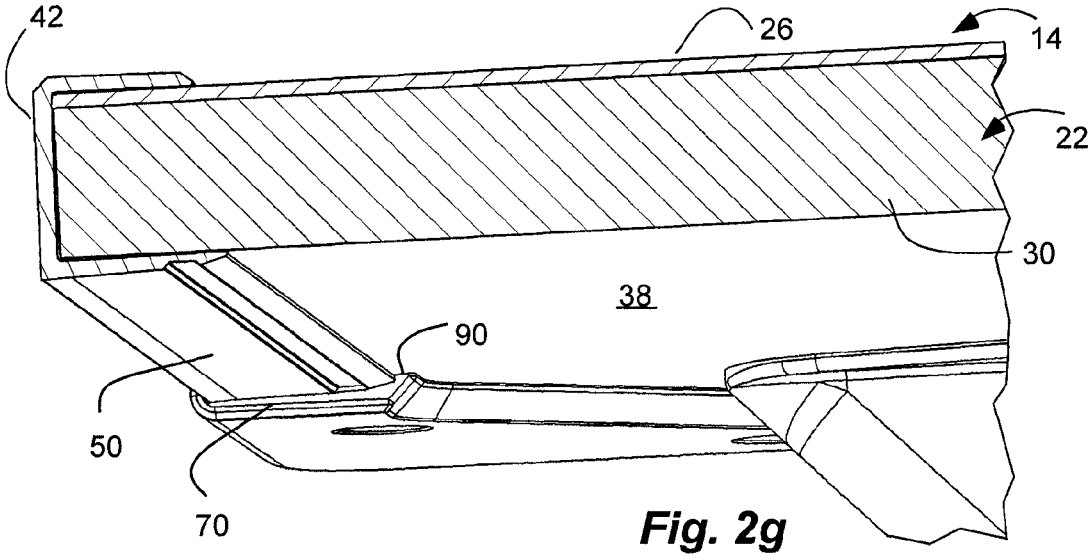
FIG. 2*g* is a partial cross-sectional perspective view of the table of FIG. 1*a;*
Figure 2H:
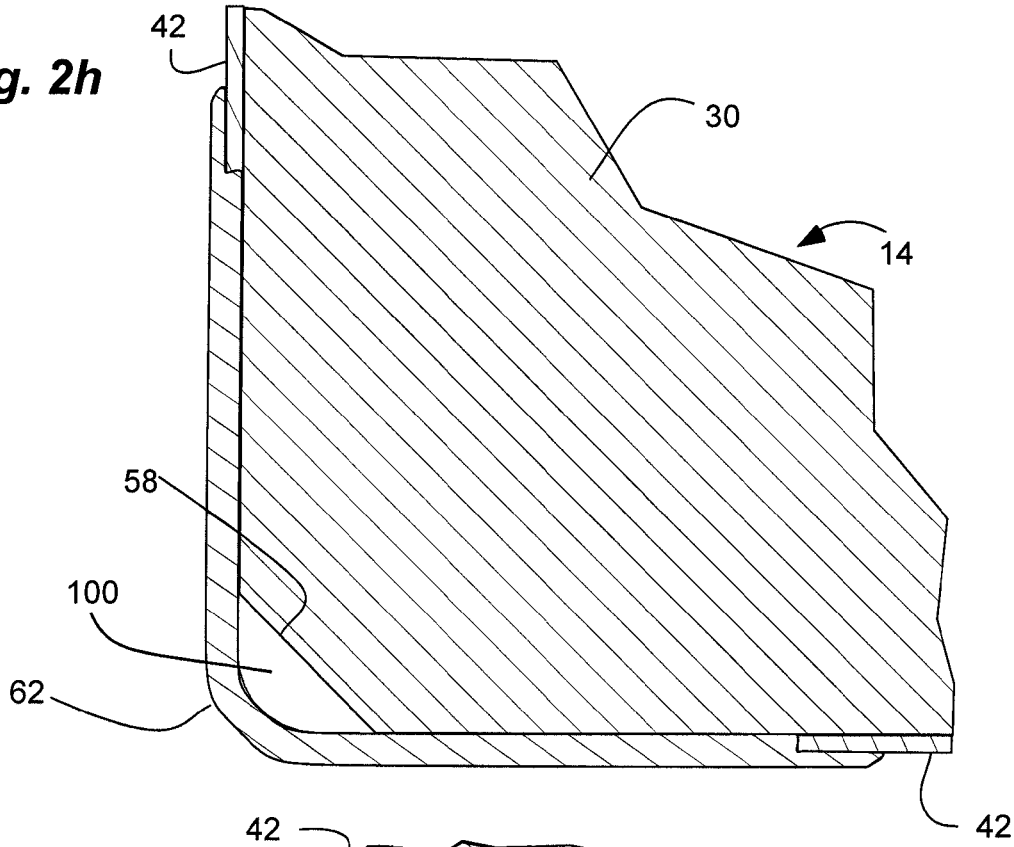
FIG. 2*h* is a partial cross-sectional top view of the table of FIG. 1*a;*
Figure 2I:
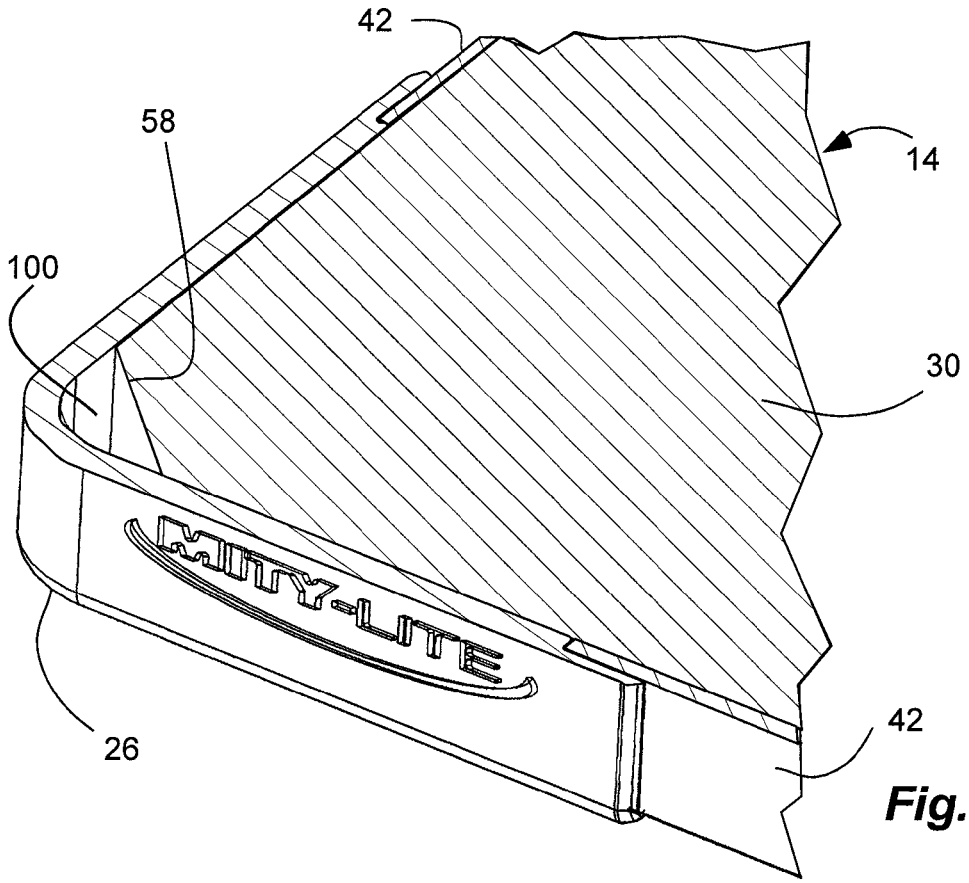
FIG. 2*i* is a partial cross-sectional perspective view of the table of FIG. 1*a;*
Figure 2J:
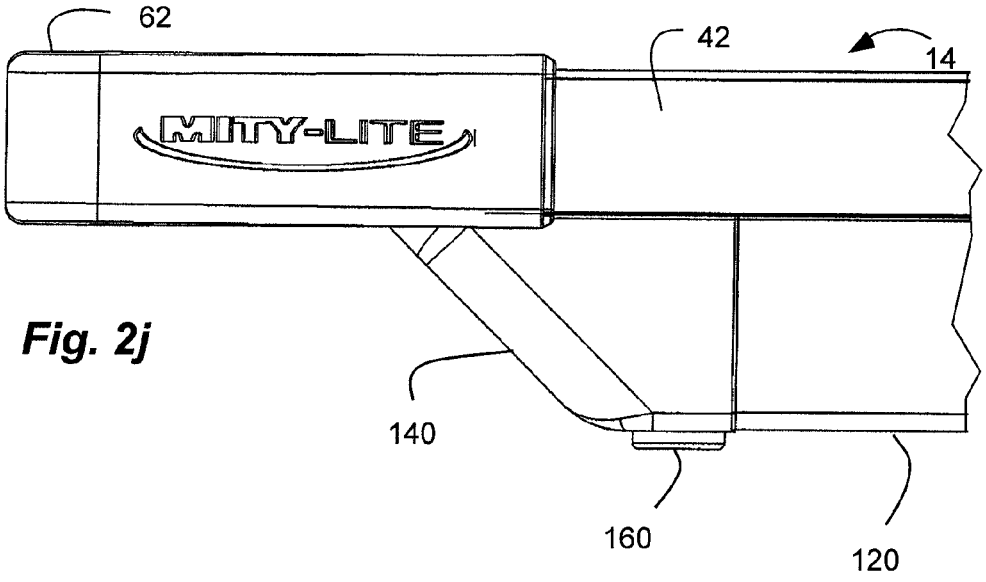
FIG. 2*j* is a partial side view of the table of FIG. 1*a;*
Figure 2K:
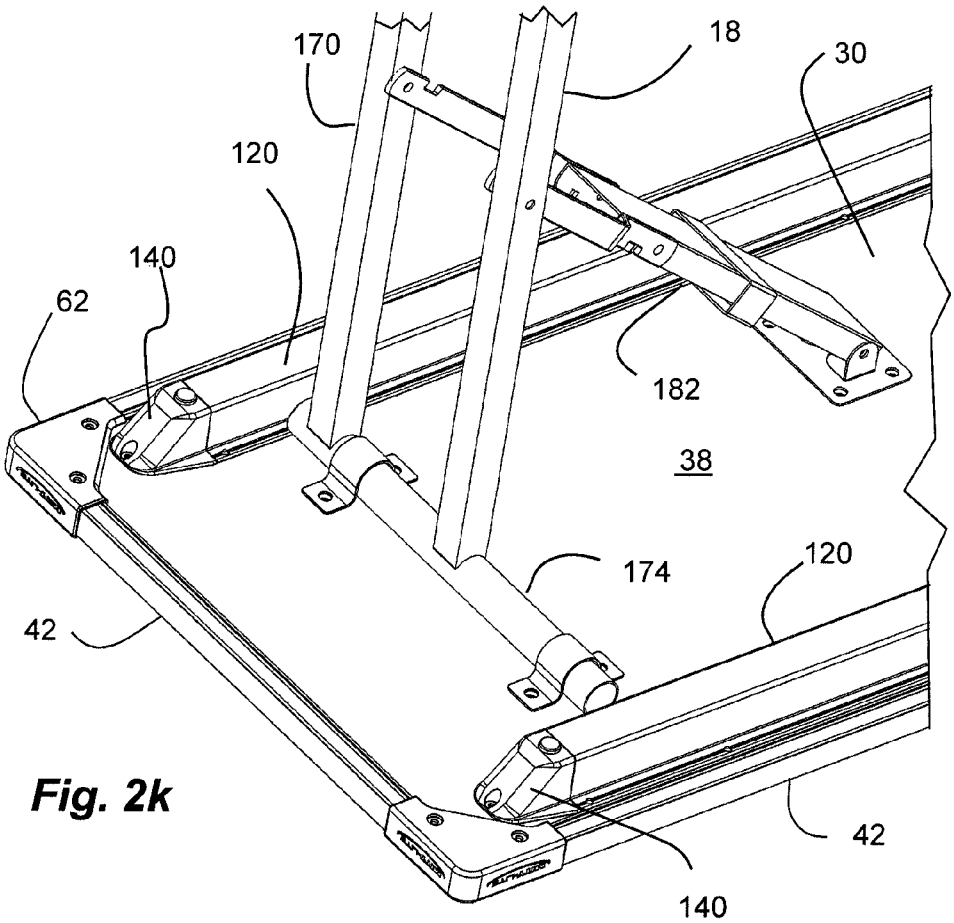
FIG. 2*k* is a partial bottom perspective view of the table of FIG. 1*a;*

The edge channel 42 can have a bottom flange 50 and a top flange 54 (FIG. 2*e*). The bottom flange can be longer than the top flange. Thus, the bottom flange 50 extends into the laminate a greater distance than the top flange; and the top flange leaves a greater surface area of the top working surface exposed. The distal edges of the flanges can be tapered towards the laminate to eliminate sharp edges. A bur can be formed on the proximate edge of the bottom flange to create a drip edge. The edge channel can be formed of aluminum by extrusion. Alternatively, the edge channel can be formed of plastic.

The outermost perimeter of the laminate or plywood layer can be interrupted only at corner voids 58 (FIGS. 2*h* and 2*i*) that are cut-out or chamfered in each corner. The corner voids can extend into the plywood sheet and/or plastic sheet. The corner voids can be formed by cutting the corner voids out of the plywood layer and/or plastic sheet, such as by cutting or stamping.

Figure 3A:
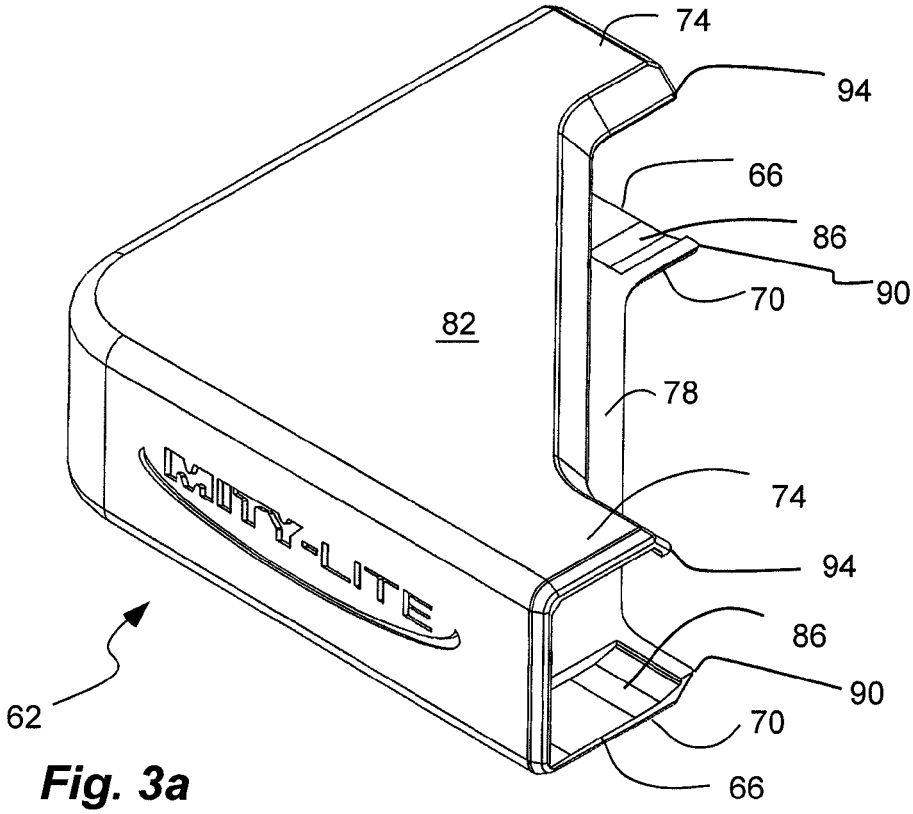
FIG. 3*a* is a top perspective view of a corner cap of the table of FIG. 1*a;*
Figure 3B:
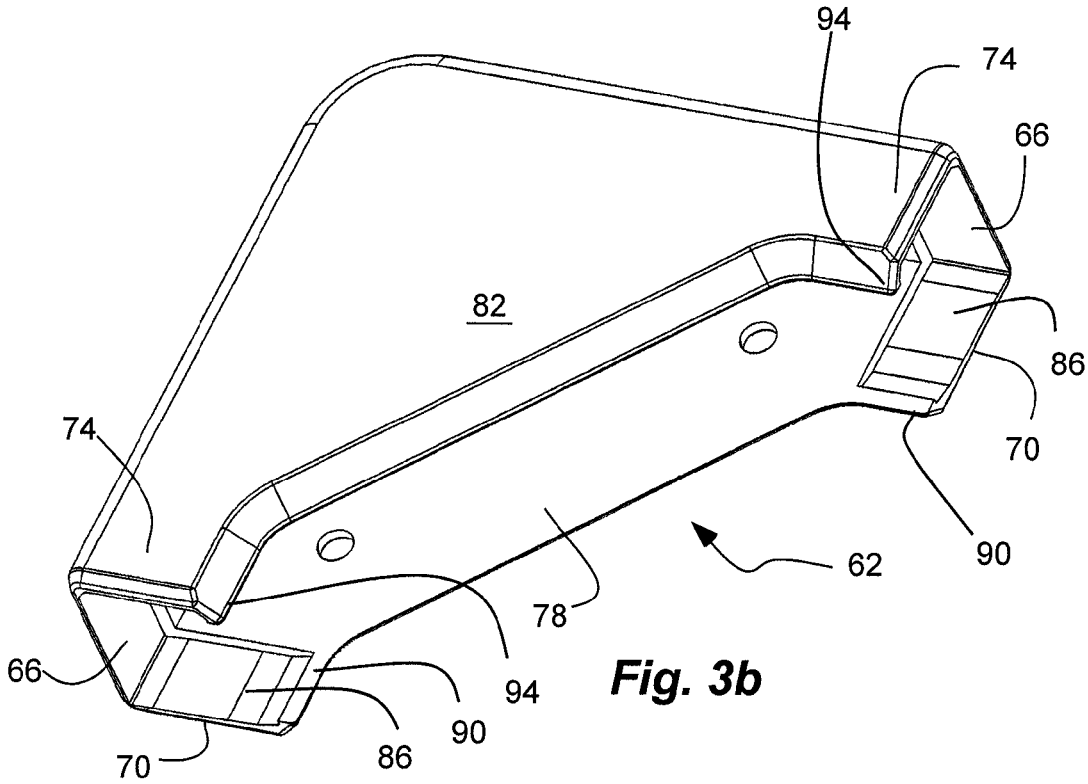
FIG. 3*b* is a bottom perspective view of the corner cap of FIG. 3*a;*
Figure 4A:
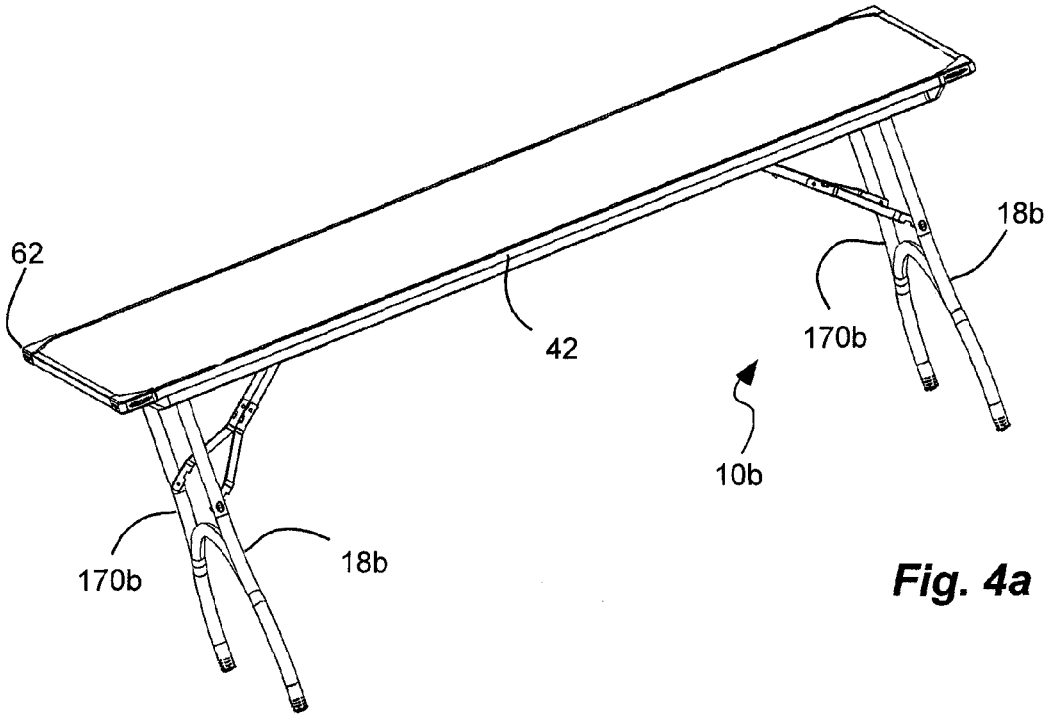
FIG. 4*a* is a top perspective view of a table in accordance with an embodiment of the present invention.
Figure 4B:
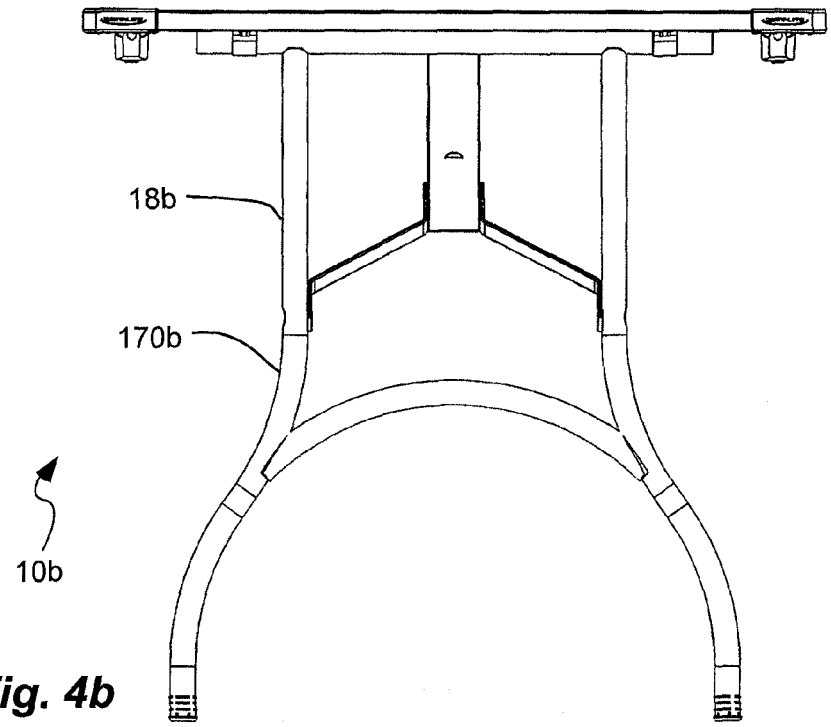
FIG. 4*b* is a side view of the table of FIG. 4*a;*
Figure 4C:
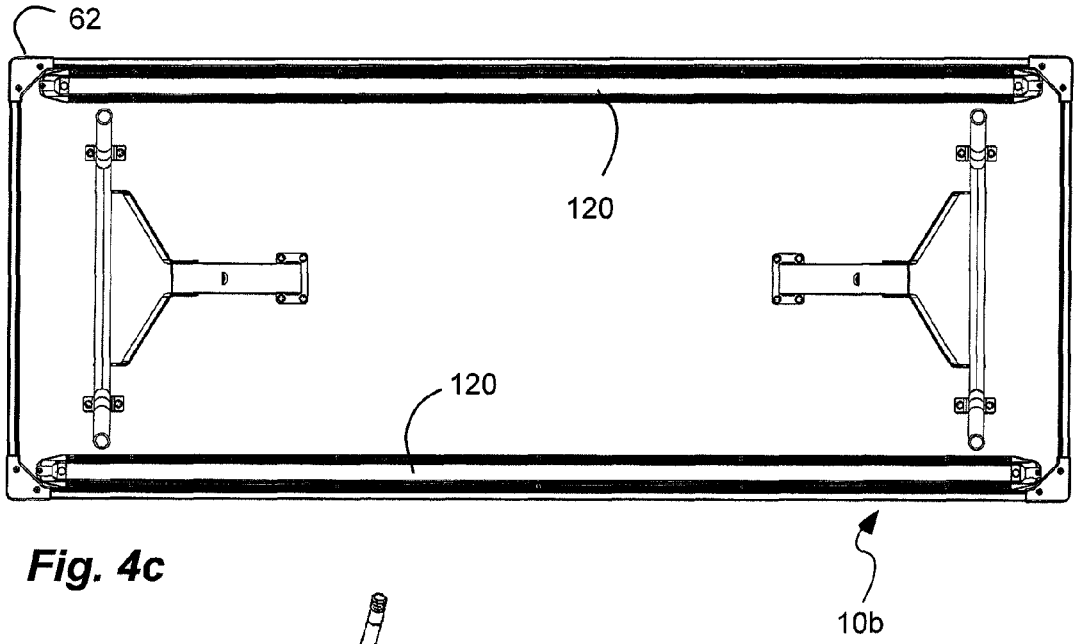
FIG. 4*c* is a bottom view of the table of FIG. 4*a;*
Figure 4D:
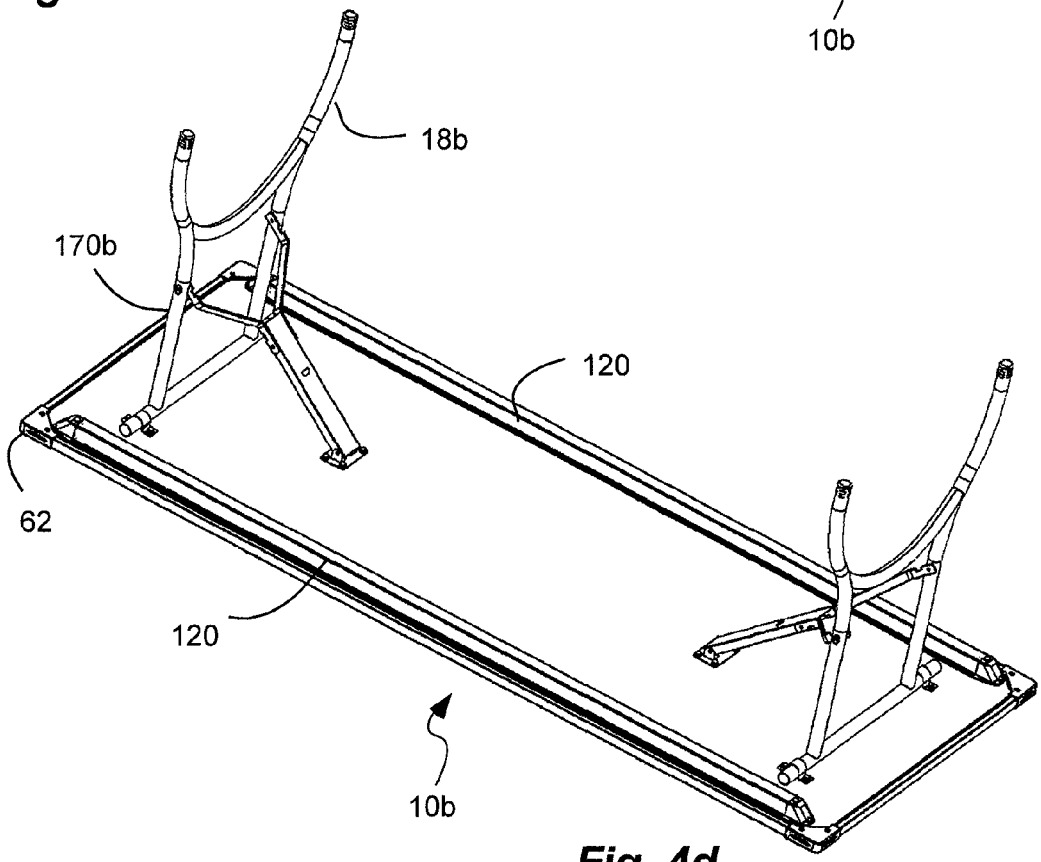
FIG. 4*d* is a bottom perspective view of the table of FIG. 4*a;*
Figure 5A:
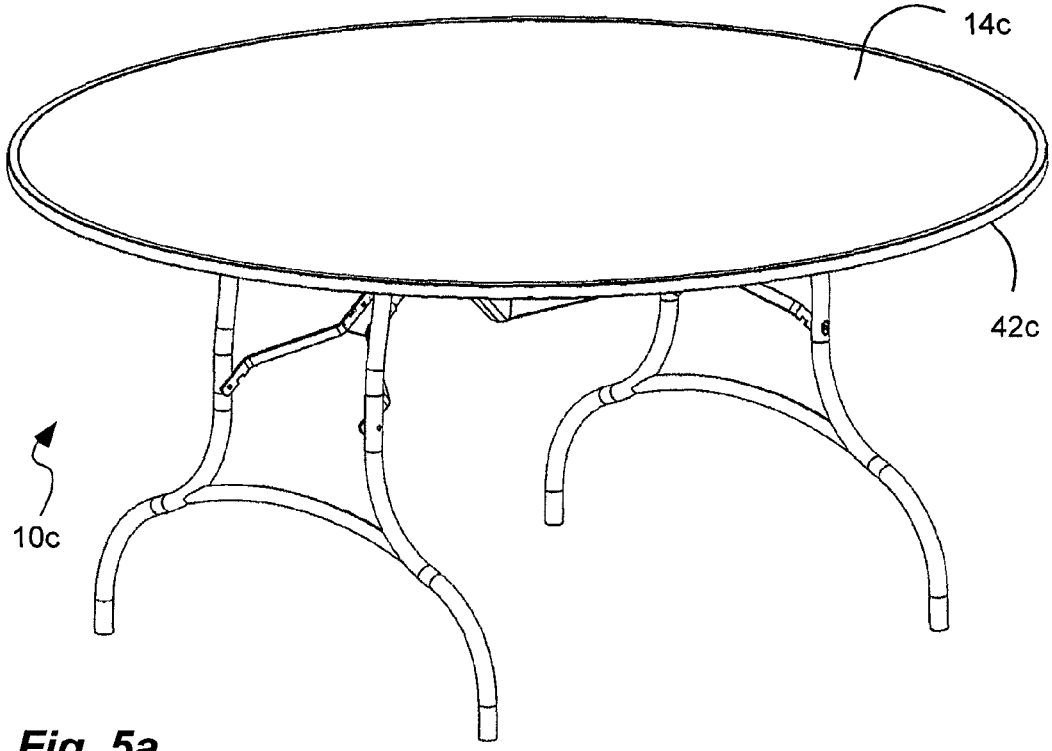
FIG. 5*a* is a top perspective view of a table in accordance with an embodiment of the present invention.
Figure 5B:
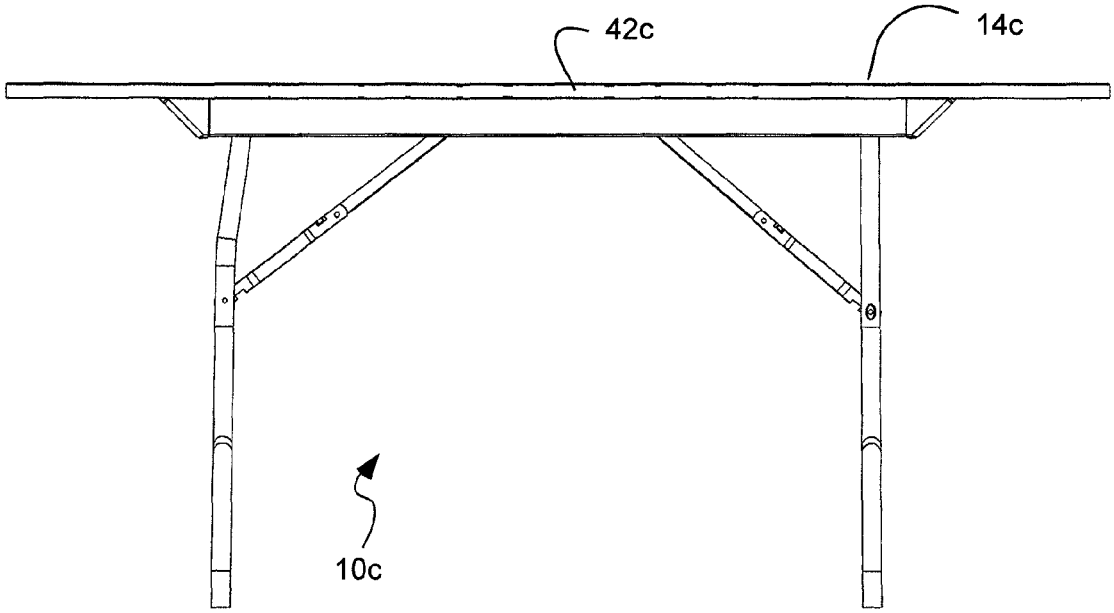
FIG. 5*b* is a side view of the table of FIG. 5*a;*
Figure 5C:
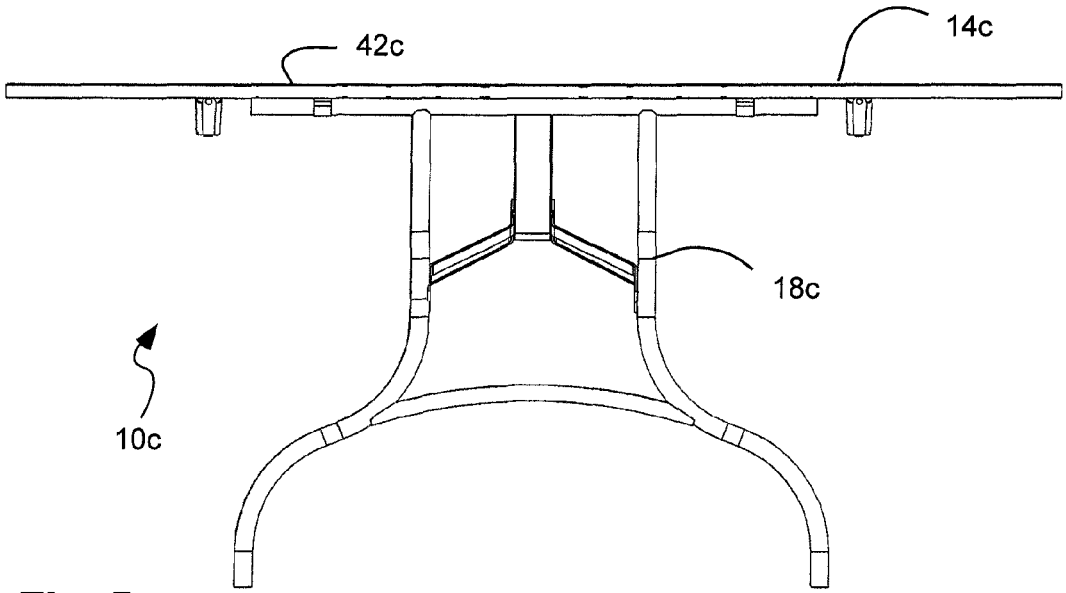
FIG. 5*c* is a side view of the table of FIG. 5*a;*
Figure 5D:
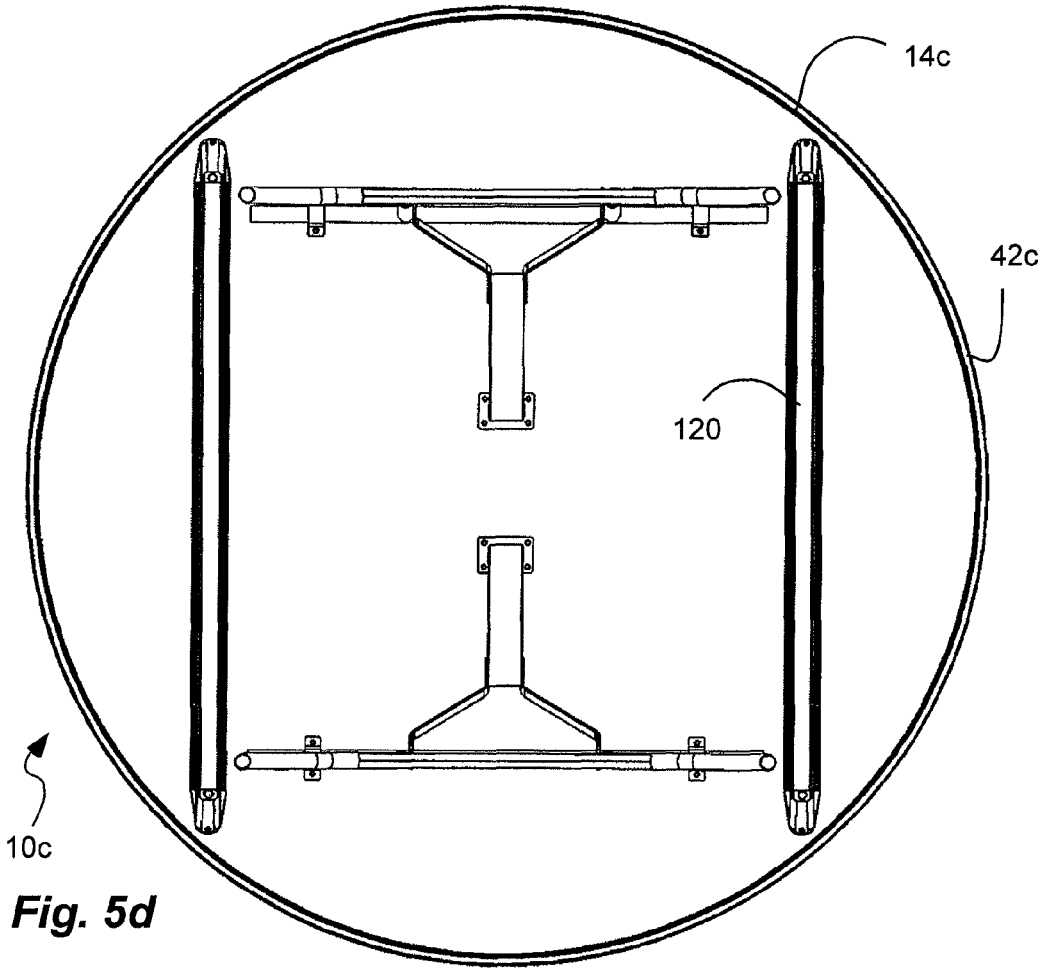
FIG. 5*d* is a bottom view of the table of FIG. 5*a*.
Figure 5E:
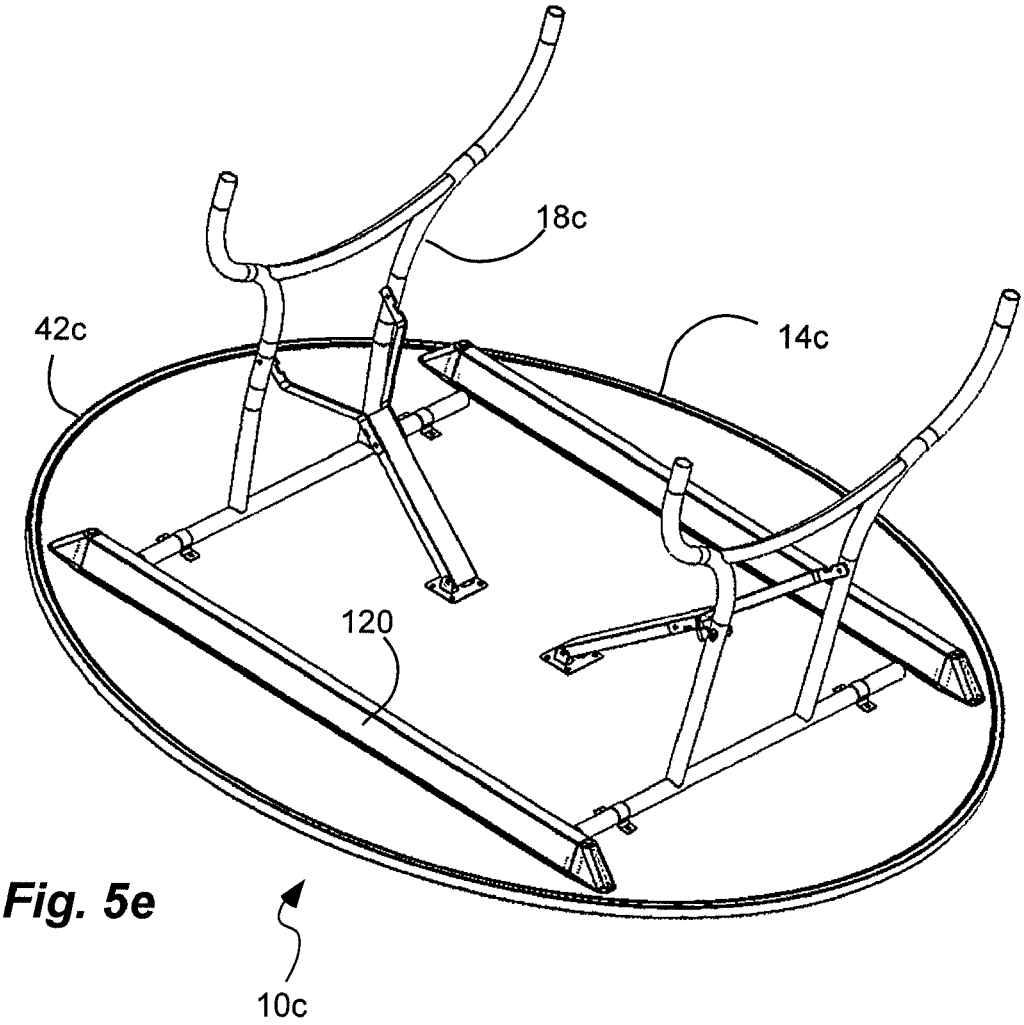
FIG. 5*e* is a bottom perspective view of the table of FIG. 5*a*.

Corner caps 62 are removably disposed on and cover the corners of the laminate. In addition, the corner caps 62 overlapping the distal ends of the edge channel 42 at the corner. Each corner cap has opposite channels 66 (FIGS. 3*a* and 3*b*) (or a pair or orthogonal channels in the case of a rectangular or square table) receiving the opposite adjacent edges of the laminate and opposite ends of adjacent edge channel. Each channel 66 of the corner cap can have a bottom flange 70 longer than a top flange 74 of the corner cap (FIGS. 3*a* and 3*b*). In addition, each corner cap can have a bottom web 78 and a top web 82 each extending between opposite sides.

The opposite channels 66 of the corner caps 62 can have a notch or enlarged cavity 86 (FIGS. 3*a* and 3*b*) to receive the opposite ends of adjacent edge channels. Thus, an interior of the corner caps can abut to the top and bottom of the laminate, top and bottom of the edge channels, the perimeter side of the laminate, and the perimeter side of the channel, to provide a snug fit. The cross-section (perpendicular to a longitudinal axis of the edge channel) at the notch or enlarged cavity 86 provides an enlarged recess with a reduced opening to enclose the distal ends of the edge channel. The opposite channels 66 or flanges 70 and 74 can have lower and upper lips 90 and 94 disposed on the respective bottom and top flanges 70 and 74 of the corner caps, defining the reduced opening. The upper lip 94 can extend over a distal edge of the top flange 74, and can abut to the upper surface 34 of the plastic sheet 26. The lower lip 90 can extend over a distal edge of the bottom flange 70, and can abut to the bottom surface 38 of the plywood layer 30. Similarly, the lips can extend along the top and bottom webs. Thus, the corner caps provide a finished edge along the surfaces of the table.

The corner caps 62 can be formed of a plastic material that can be flexible to protect the corner of the laminate and the table. The corner caps can snap fit over the edge channel. In addition, one or more mechanical fasteners, such as screws, can extend through a bottom of the corner caps and into the plywood layer. Alternatively, the corner caps can be sacrificial to break upon impact. The corner caps can be removable to allow for replacement of damaged or marred caps.

A lateral gap or space 100 can be formed between a lateral corner edge of the laminate and an inner lateral side of the corner cap 62. The corner cap can be deflectable into the lateral gap or space under impact. In addition, top and bottom gaps or spaces 104 and 106 can be formed between the top web 80 and the upper working surface 30 and the bottom web 76 and the bottom surface 34 of the plywood layer, respectively. Again, the corner cap can be deflectable into the top and bottom gaps or spaces under impact.

One or more runners 120 can be coupled under the table top 14 to provide stability and support to the laminate, and help maintain the strength and flatness of the upper working surface. The runner can include a channel with an open side of the channel coupled to the table top. Lateral flanges 124 can extend from the channel through which mechanical fasteners, can extend, such as screws, or chemical fasteners, such as adhesive, to attach the channel to the plywood layer. The runners 120 can be coupled directly to the bottom surface 38 of the plywood layer 30; thus facilitating manufacture. The runners can be formed of aluminum and can be fabricated by extrusion. A pair of runners can be disposed along the long ends of the table and can extend substantially the entire length of the table.

Runner caps 140 can be coupled to open opposite ends of the runner 120. The runner 140 can include an insert portion disposed in the channel of the runner, and an enlarged portion that covers distal edges of the runner. Covering the distal edges of the runner protects adjacent tables or the working surfaces thereof when stacked together. The enlarged portion can include wings that match the lateral flanges of the runners. In addition, a bumper 160 (FIG. 2*j*) can be coupled to the runner cap 140, and can extend beyond the runner to abut to an adjacent stacked table.

The leg assemblies 18 can further include one or more legs 170 attached to a pivot 174 coupled to the bottom surface 38 of the plywood layer 30. A foot 178 can be disposed on the opposite end of the legs, opposite the pivot. Such a foot can have a similar width to that of the table top to resist tipping. A linkage 182, as known in the art, can be coupled between the plywood layer 30 and the legs 170. The linkage can include two pivotal links and a locking member that can removably cover the pivot between the links to selectively maintain the legs in the open position.

As stated above, the table 10 can be configured as a conference table, i.e. can be long and narrow or shallow to accommodate numerous rows. In addition, the legs 170 or leg assemblies 18 can be off-center with respect to a longitudinal axis of the table. Such a configuration positions the legs 170 and linkage nearer a back of the table top, providing more leg room at the front of the table top and resisting user's kicking their knees into the legs or linkages.

A method for fabricating a table as described above includes bonding an ABS plastic sheet to a plywood layer to form a laminate. Perimeter sides of the laminate are enclosed with an edge channel, but corners of the laminate are left exposed with respect to the edge channel. Corners of the laminate and ends of adjacent edge channels are covered with corner caps, but a gap or space is left between the lateral edge of the corner of the laminate and the corner caps and/or between upper and lower surfaces of the laminate and the corner caps. Runners can be directly coupled to the plywood layer under the table top.

A method for protecting a table includes obtaining a folding table with a laminate formed by a plastic sheet bonded to a plywood layer and a perimeter edge of the laminate enclosed by an edge channel without enclosing corners of the laminate and corner caps removably disposed over the corners of the laminate. A damaged corner cap is removed and replaced with a new corner cap.

Referring to FIGS. 4*a-d*, another table 10*b* is shown that is similar in most respect to that described above, and which description is herein incorporated by reference. The table 10*b* can be configured as a rectangular table for use with users sitting all around the table, as opposed to one side. Thus, the legs 170*b* and leg assemblies 18*b* can be aligned with the longitudinal axis of the table.

Although the tables above have been described as having rectangular shapes, it will be appreciated that the tables can have other shapes, such as polygonal, hexagonal, octagonal, circular, semi-circular, etc. Referring to FIGS. 5*a-e*, another table 10*c* is shown that is similar in most respect to that described above, and which description is herein incorporated by reference. The table 10*c* and table top 14*c* can be circular. The perimeter edge channel 42*c* can also be circular and can circumscribe the laminate which can also be circular. A pair of leg assemblies 18*c* can be coupled to the table top.

The table tops described above can also be used with fix leg(s).

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The invention claimed is:

1. A light-weight, folding table device, comprising:

a) a table top with a plurality of folding legs coupled to the table top and pivotal between an extended position maintaining the table top in an elevated position, and a collapsed position towards the table top;

b) the table top including a laminate with a plastic sheet bonded to a plywood layer, the plastic sheet defining an upper working surface of the table top;

c) perimeter edge channels disposed along sides of the laminate with lengths shorter than corresponding sides of the laminate leaving the corners of the laminate exposed; and d) corner caps covering the corners of the laminate, the corner caps overlapping ends of the perimeter edge channels at the corner.

2. A device in accordance with claim 1, further comprising:

a lateral gap formed between a lateral corner edge of the laminate and an inner lateral side of the corner cap; and the corner cap being made of a flexible material and deflectable into the lateral gap under impact.

3. A device in accordance with claim 1, further comprising:

each corner cap having opposite channels receiving opposite adjacent edges of the laminate and ends of adjacent perimeter edge channels.

4. A device in accordance with claim 3, further comprising:

each channel of the corner cap having a notch receiving an end of an edge channel.

5. A device in accordance with claim 3, further comprising:

each channel of the corner cap having a bottom flange longer than a top flange of the corner cap.

6. A device in accordance with claim 5, further comprising:

upper and lower lips disposed on the respective top and bottom flanges of the corner caps, the upper lip extending over a distal edge of the top flange and abutting to the upper surface of the plastic sheet, the lower lip extending over a distal edge of the bottom flange and abutting to the bottom surface of the plywood layer.

7. A device in accordance with claim 1, wherein the plywood layer has a bottom surface with at least a majority thereof exposed without being covered.

8. A device in accordance with claim 7, further comprising:

at least one runner coupled under the table top and including a channel oriented with lateral flanges of an open side of the channel coupled to the bottom surface of the plywood layer.

9. A device in accordance with claim 8, further comprising:

runner caps coupled to open opposite ends of the runner, the runner caps covering distal edges of the runner.

10. A device in accordance with claim 9, further comprising:

a bumper coupled to the runner cap and extending beyond the runner to abut to an adjacent stacked table.

11. A light-weight, folding table device, comprising:

a) a table top with a plurality of folding legs coupled to the table top and pivotal between an extended position maintaining the table top in an elevated position, and a collapsed position towards the table top;

b) the table top including a laminate with a plastic sheet bonded to a plywood layer, the plastic sheet defining an upper working surface of the table top, the plywood layer having a bottom surface with at least a majority thereof exposed without being covered; and c) at least one runner coupled under the table top and directly to the bottom surface of the plywood layer, and including a channel oriented with lateral flanges of an open side of the channel coupled to the bottom surface of the plywood layer.

12. A device in accordance with claim 11, further comprising:

runner caps coupled to open opposite ends of the runner, the runner caps covering distal edges of the runner.

13. A device in accordance with claim 12, further comprising:

a bumper coupled to the runner cap and extending beyond the runner to abut to an adjacent stacked table.

14. A device in accordance with claim 11, further comprising:

a) perimeter edge channels disposed along sides of the laminate with lengths shorter than corresponding sides of the laminate leaving the corners of the laminate exposed; and b) corner caps covering the corners of the laminate, the corner caps overlapping ends of the perimeter edge channel at the corners.

15. A device in accordance with claim 14, further comprising:

a lateral gap formed between a lateral corner edge of the laminate and an inner lateral side of the corner cap; and the corner cap being made of a flexible material and deflectable into the lateral gap under impact.

16. A device in accordance with claim 14, further comprising:

each corner cap having opposite channels receiving opposite adjacent edges of the laminate and opposite ends of adjacent edge channel; and each channel of the corner cap having a bottom flange longer than a top flange of the corner cap.

17. A device in accordance with claim 16, further comprising:

upper and lower lips disposed on the respective top and bottom flanges of the corner caps, the upper lip extending over a distal edge of the top flange and abutting to the upper surface of the plastic sheet, the lower lip extending over a distal edge of the bottom flange and abutting to the bottom surface of the plywood layer.

18. A light-weight, folding table device, comprising:

a) a table top with a plurality of folding legs coupled to the table top and pivotal between an extended position maintaining the table top in an elevated position, and a collapsed position towards the table top;

b) the table top including a laminate with an ABS plastic sheet bonded to a plywood layer, the plastic sheet defining an upper working surface of the table top, the plywood layer having a bottom surface with at least a majority thereof exposed without being covered;

c) perimeter edge channels disposed along sides of the laminate with lengths shorter than corresponding sides of the laminate leaving the corners of the laminate exposed, the channel having a bottom flange longer than a top flange of the channel;

d) corner caps covering the corners of the laminate, the corner caps overlapping ends of the perimeter edge channels at the corner, each corner cap having opposite channels receiving opposite adjacent edges of the laminate and opposite ends of adjacent edge channel, each channel of the corner cap having a bottom flange longer than a top flange of the corner cap, each corner cap having a bottom web and a top web each extending between opposite sides;

e) upper and lower lips disposed on the respective top and bottom flanges of the corner caps, the upper lip extending over a distal edge of the top flange and abutting to the upper surface of the plastic sheet, the lower lip extending over a distal edge of the bottom flange and abutting to the bottom surface of the plywood layer;

f) a lateral gap or space formed between a lateral corner edge of the laminate and an inner lateral side of the corner cap, and the corner cap being made of a flexible material and deflectable into the lateral gap or space under impact;

g) at least one runner coupled under the table top and including a channel oriented with lateral flanges of an open side of the channel coupled to the bottom surface of the plywood layer;

h) runner caps coupled to open opposite ends of the runner, the runner caps covering distal edges of the runner; and i) a bumper coupled to the runner cap and extending beyond the runner to abut to an adjacent stacked table.

19. A method for fabricating a table device in accordance with claim 18, comprising:

bonding an ABS plastic sheet to a plywood layer to form a laminate;

enclosing perimeter sides of the laminate with an edge channel but leaving corners of the laminate exposed with respect to the edge channel;

covering corners of the laminate and ends of adjacent edge channels with corner caps, but leaving a gap or space between the lateral edge of the corner of the laminate and the corner caps and/or between upper and lower surfaces of the laminate and the corner caps; and securing runners directly to the plywood layer under the table top.

20. A method for protecting a table device in accordance with claim 17, comprising:

obtaining a folding table with a laminate formed by a plastic sheet bonded to a plywood layer and a perimeter edge of the laminate enclosed by an edge channel without enclosing corners of the laminate and corner caps removably disposed over the corners of the laminate;

removing a damaged corner cap; and replacing the damaged corner cap with a new corner cap.

* * * * *